United States Patent [19]

Newberry

[11] Patent Number: 4,640,383

[45] Date of Patent: Feb. 3, 1987

[54] MOVABLE STAGING SCAFFOLD SYSTEM FOR BUILDING CONSTRUCTION

[76] Inventor: Claude A. Newberry, 4970 Avenida de Carmen, Santa Clara, Calif. 95054

[21] Appl. No.: 825,224

[22] Filed: Feb. 3, 1986

[51] Int. Cl.[4] ..... E04G 1/22; E04G 1/36

[52] U.S. Cl. ..... 182/38; 182/2; 182/63; 182/142

[58] Field of Search ..... 182/2, 63, 38, 12–14, 182/82, 129, 142

[56] References Cited

U.S. PATENT DOCUMENTS

| | | | |
|---|---|---|---|
| 972,576 | 10/1910 | Scully | 182/38 |
| 2,311,932 | 2/1943 | Deckard | 182/38 |
| 2,814,533 | 11/1957 | Van Horn | 182/38 |
| 3,504,461 | 4/1970 | Copeland | 182/2 |
| 3,841,436 | 10/1974 | Grove | 182/2 |
| 4,271,926 | 6/1981 | Cullity | 182/63 |
| 4,300,657 | 11/1981 | Thompson | 182/38 |
| 4,378,860 | 4/1983 | Newberry | 182/14 |
| 4,396,092 | 8/1983 | Thompson | 182/38 |

*Primary Examiner*—Reinaldo P. Machado
*Attorney, Agent, or Firm*—Linval B. Castle

[57] ABSTRACT

A work scaffold system including a frame structure having spaced, parallel upper and lower horizontal track members upon which a pair of vertical column members may be horizontally moved. The vertical members have tracks for the vertical movement of worker cars. The structure supporting the horizontally and vertically movable worker cars are positioned in a desired location adjacent the face of a building by a truck crane or the like which is attached to the scaffold system by a hydraulically powered knuckle assembly attached between the crane head and the scaffold to provide control of both horizontal and vertical axes of rotation for proper attitude alignment of the scaffold.

8 Claims, 6 Drawing Figures

MOVABLE STAGING SCAFFOLD SYSTEM FOR BUILDING CONSTRUCTION

BRIEF SUMMARY OF THE INVENTION

This invention relates to work staging scaffold systems and particularly to an improved scaffold positioned by a truck crane or the like for placing work teams at any desired position at the face of a building.

The invention described and claimed herein is an improvement over a similar type of scaffold system described in my U.S. Pat. No. 4,378,860 issued on Apr. 5, 1983. That prior art patent describes a work staging scaffold system suspended by cables from some elevated structure on the building, the scaffold including a frame having horizontal track members and vertical track members movable along the horizontal members and supporting vertically movable worker's pods or cars spaced from the face of a building by spacing members secured to the scaffold system and contacting the building. To horizontally move the entire scaffold system to a different location along the face of the building, it is generally necessary to lower the system to ground, reattach the suspension cables at the new location, and then raise the scaffold scaffold to the desired vertical position.

The present improvement eliminates the scaffold repositioning problems mentioned above and provides means for erecting the scaffold against the face of a building without need of any contact with any part of the building. The system may therefore be employed in the actual construction of a building as well as for exterior finishing or maintenance, such as for painting, repairs, window installation, etc.

Briefly described, the scaffold system includes a rectangular frame structure having top and bottom horizontal rails for the horizontal movement of a pair of vertical column members, each supporting a worker's car vertically movable thereon. The cars may thus move vertically on their respective column members and the column members move horizontally along the rails of the frame structure. Located near the center of the frame member is a vertical support plate to which is attached a hydraulically powered knuckle assembly for maintaining the frame member and the scaffold in a vertical plane adjacent a building face. The knuckle is attached to the boom head of a truck crane or the like so that the entire scaffold system is support from ground level and may be readily maneuvered to different positions.

BRIEF DESCRIPTION OF THE DRAWINGS

In the drawings which illustrate the preferred embodiment of the invention.

DETAILED DESCRIPTION OF THE PREFERRED EMBODIMENT

Figure 1:
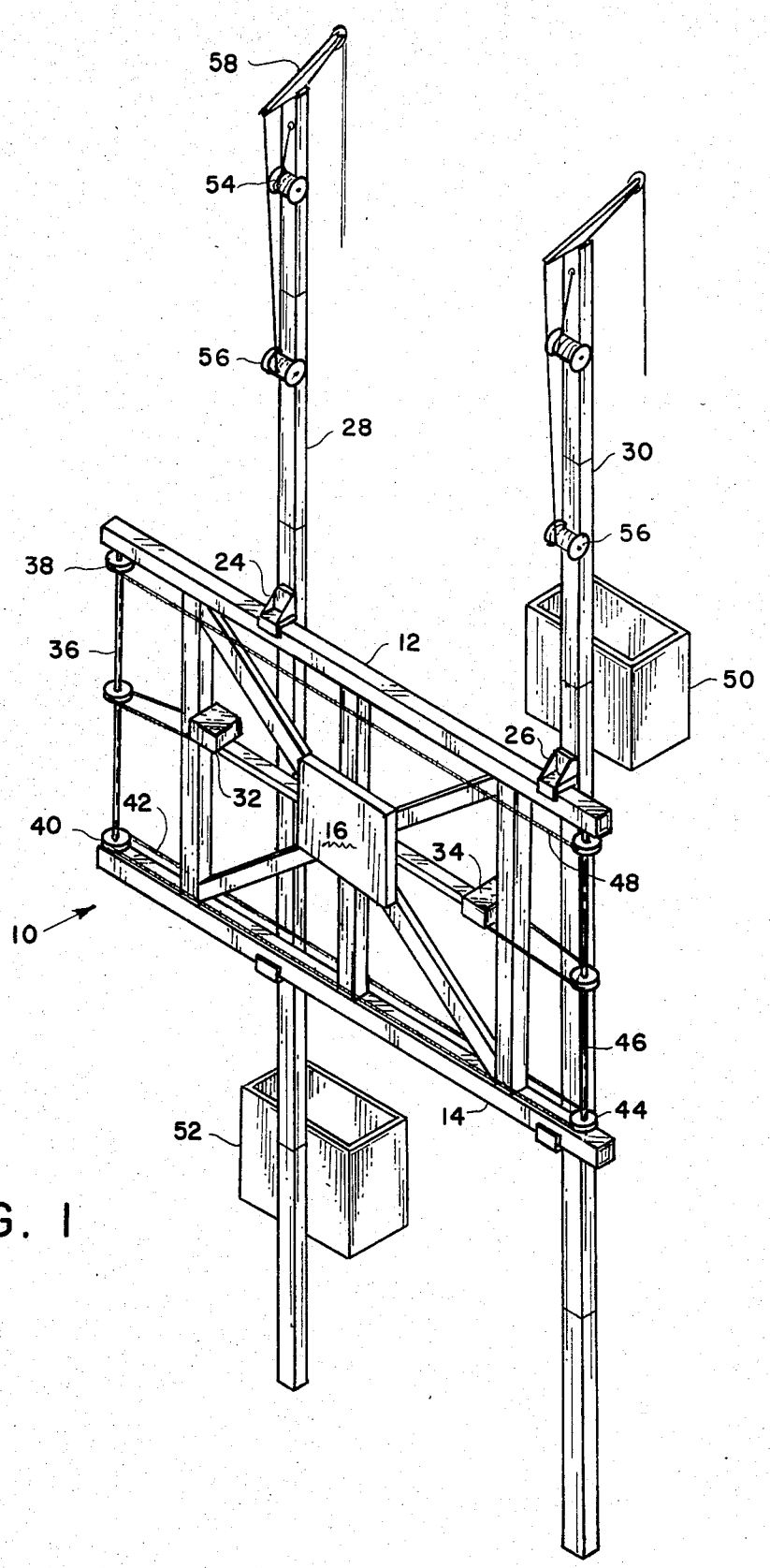
FIG. 1 is a perspective drawing illustrating the adjustable scaffold system.

In the embodiment illustrated in FIG. 1 a rectangular frame structure 10 includes a top rail 12 and a spaced bottom rail 14 parallel with the rail 12 and preferably about eight feet in length. During operation, the frame structure 10 is positioned to lie in a vertical plane parallel with and spaced from the face of a building. Centrally attached in the frame structure 10 is a support plate 16 to which is attached a hydraulically controlled positioning knuckle 18 mounted on the head 20 of a crane boom 22 as shown in FIG. 2 and which will later described.

Mounted for horizontal movement on bearing carriages 24 and 26 along the top and bottom rails 12, 14 are vertical column members 28 and 30 which, in the preferred embodiment, are about thirty six feet in length and, for portability, may be formed of interconnected shorter lengths of 4"×4" construction aluminum. Each of the column members 28, 30 are horizontally moved along the rails by a chain driven by a geared electric motor and sprocket drive 32, 34 attached to a the frame structure 10 as shown in FIG. 1 and controllable from the respective work car. Thus, the drive 32 operates to rotate a sprocket on the vertical shaft 36 which has on one end one freely rotating sprocket 38 and also a driven sprocket 40 at the opposite end. A drive chain 42 on the driven sprocket 40 engages a freely rotating sprocket 44 on the vertical shaft 46 on the opposite end of the frame structure and is attached to the vertical column member 28 so that operation of the drive motor 32 in one direction will move the vertical column member 28 along the horizontal rails 12, 14. A similar drive system controlled from within the workcar 50 includes the drive 34 and drive chain 48 attached to the vertical column member 30 and operates to horizontally move that member along the horizontal rails 12, 14.

Pods or workcars 50 and 52 are attached for vertical movement along the vertical column members. The vertical movement of each car is controlled by a cable winch 54 located near the top of the upper section of each column member 28, 30, and permits each of the two workcars to vertically move approximately thirty feet along the column. In addition to the workcar winches 54, each vertical column member supports a hoist winch 56 and cable hoist 58 atop the column member for lifting and lowering the various tools, construction materials and repair parts for use by the workcar occupants.

Figure 2:
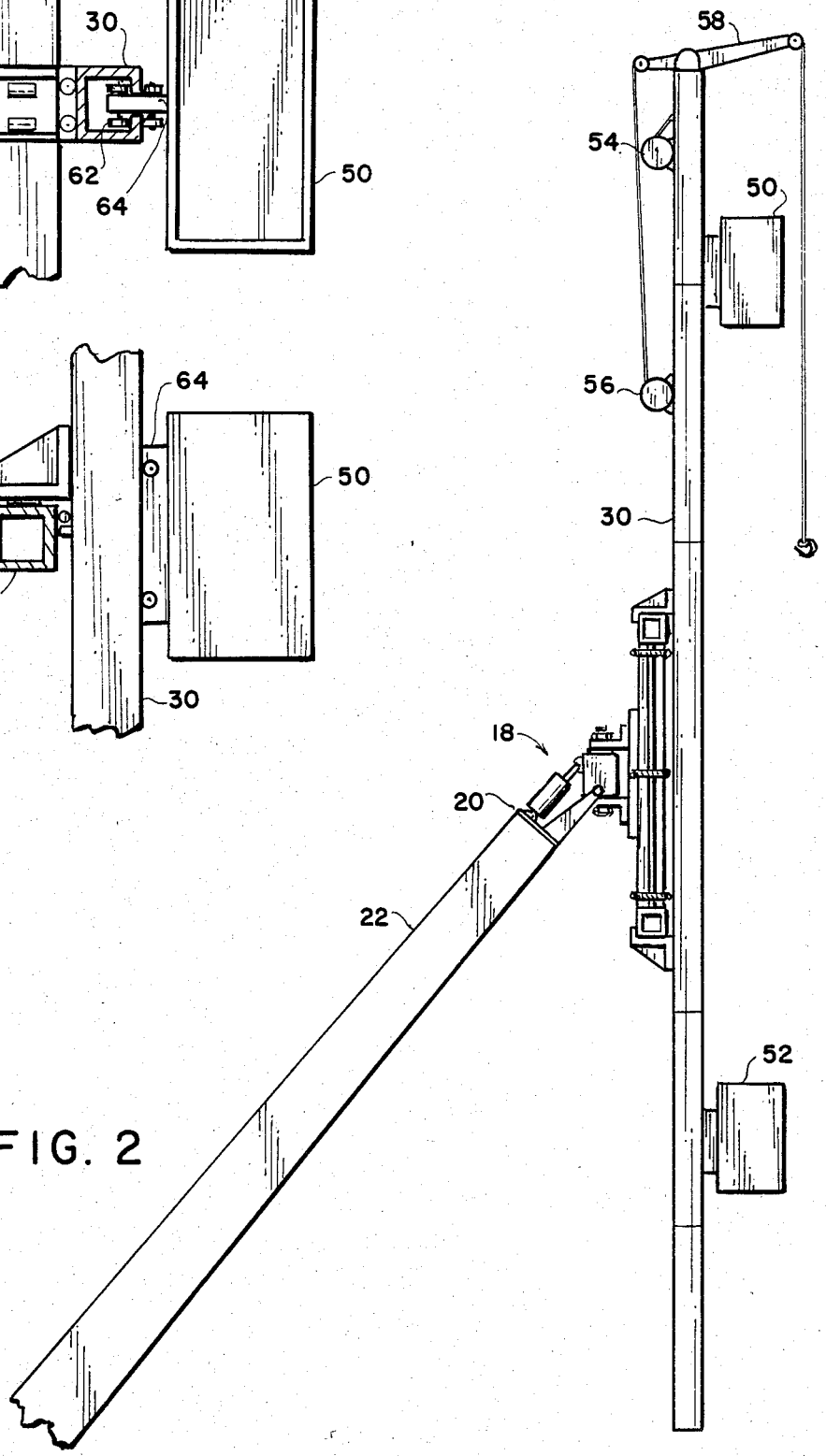
FIG. 2 is a side elevational view of the scaffold system including the knuckle system and its attachment to a crane boom head.

FIG. 2 is a side elevational view of the scaffold system and illustrates the vertical column member 30 with workcars 50, 52 and car cable winch 54, the cable hoist 58 and hoist winch 56, and the knuckle assembly 18 connecting the scaffold to the crane boom 22.

Figure 3:
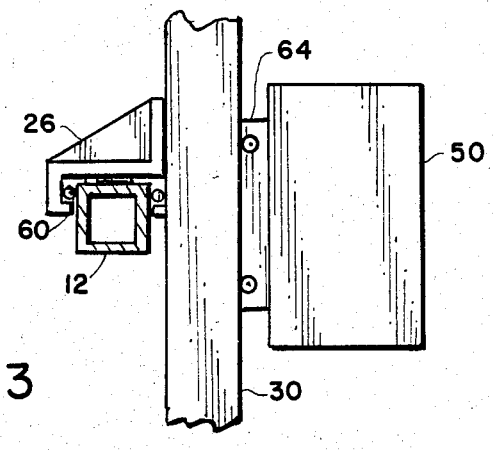
FIG. 3 is a detailed side elevational view of a work car.

FIG. 3 is a side elevational view of the workcar 50 and sections of the vertical column member 30 slideably coupled for easy horizontal movement by suitable bearings 60 to the horizontal rail 12 of the frame structure 10.

Figure 4:
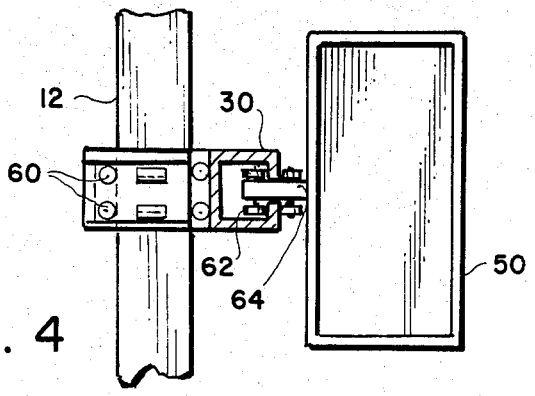
FIG. 4 is a plan view of a work car and its attachment to a column member.

FIG. 4 is a top plan view of the workcar 50 of FIG. 3 and illustrates the bearings 62 and the tongue 64 that is attached to the workcar and which rides in a narrow horizontal slot in the vertical column member 30.

Figure 6:
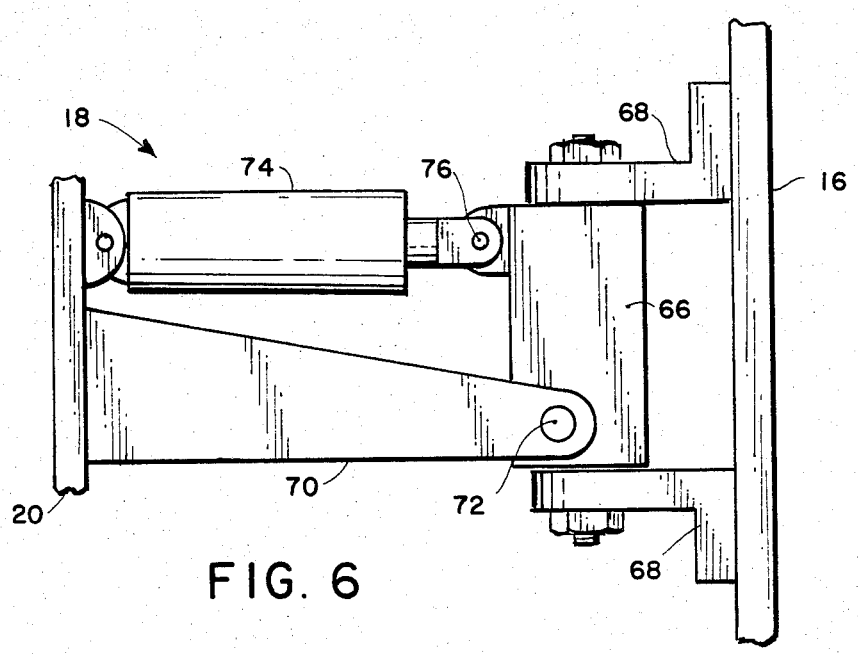
FIG. 6 is a plan view of the positioning knuckle of FIG. 5.
Figure 5:
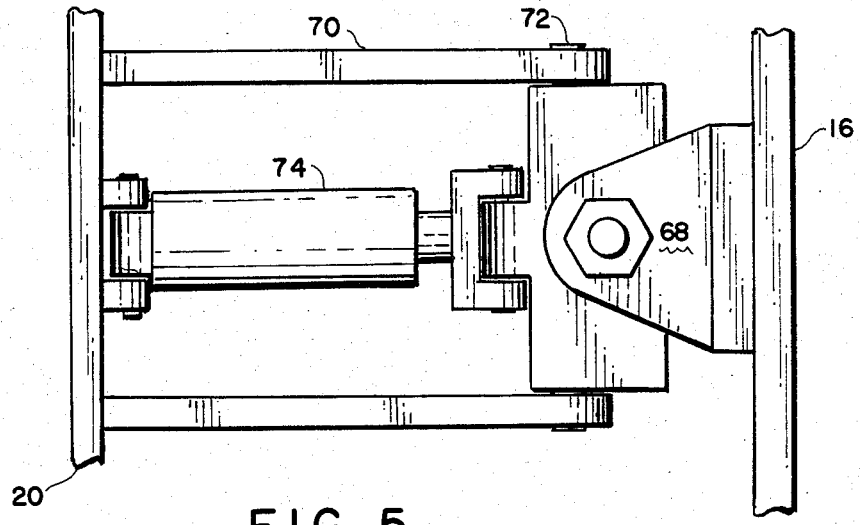
FIG. 5 is a detailed side elevation view of a positioning knuckle interconnecting the scaffold assembly to a crane boom head.

FIGS. 6 and 7 are detailed elevational and plan views, respectively, of the knuckle assembly 18 shown in FIG. 2 for controlling the attitude of the scaffold system. The knuckle assembly is attached to a crane boom head 20 andd supports the scaffold system which, in the preferred embodiment, is made of structural aluminum and weighs only approximately 1800 pounds with a 170 pound worker in each of the cars 50 and 52. The knuckle assembly 18 adds about 120 pounds more and includes a hydraulic rotator 66 pivotally secured to the central support plate 16 on the face of the scaffold frame structure by angle brackets 68 and also coupled to the crane head 20 by a pair side brackets 70 attached to the crane head and pivotally coupled at a horizontal pivot 72 to the sides of the rotator 66. Pivotal movement of the rotator 66 and its attached scaffold system about a horizontal axis is provided by a hydraulic linear actuator 74 having one end coupled to the crane head 20 and a second end to a pivot 76 on the hydraulic rotator 66 and vertically spaced from the pivot 72, as shown in FIG. 6. Thus, horizontal movement and adjustment of the entire scaffold system is accomplished by movement of the supporting crane, vertical adjustment of the entire scaffold system is provided by appropriate adjustment of the crane boom, movement and adjustment of the scaffold system about a horizontal axis and in a vertical plane is provided by the hydraulic linear actuator 74, and movement and adjustment of the system around a vertical axis is provided by the hydraulic rotator 66.

Having thus described my invention, what is claimed is:

1. A movable staging scaffold system for positioning construction and maintenance workers adjacent the face of a structure said system comprising:

a frame assembly alignable in a substantially vertical plane and having spaced, parallel, substantially horizontal upper and lower rail members;

at least one vertical columnar member mounted for horizontal movement along said upper and lower rail members;

at least one worker car coupled to said vertical columnar member and vertically moveable along said member;

a structural support attached to said frame assembly; and a knuckle assembly attached to said structural support and to a boom on a movable crane, said knuckle assembly providing powered horizontal and vertical pivotal movement between said crane boom and said scaffold system for the attitude control of said frame assembly.

2. The scaffold system claimed in claim 1 wherein said structural support is a plate attached in a substantially vertical plane to said frame assembly and wherein said knuckle assembly includes a hydraulically controlled rotator pivotally coupled to said support plate for controlling the rotation of said scaffold system around a substantially vertical axis, said knuckle assembly further including a hydraulically controlled linear actuator pivotally coupled between the head on said crane boom and said said hydraulically controlled rotator for controlling the rotation of said scaffold system around a substantially horizontal axis.

3. The scaffold system claimed in claim 2 further including first power means coupled to said frame assembly for moving said vertical columnar member along said upper and lower rail members.

4. The scaffold system claimed in claim 3 wherein said vertical columnar members are coupled to said upper and lower rail members by bearings contained within carriages attached to said columnar members.

5. The scaffold system claimed in claim 4 wherein said worker car vertically slides in track means in said vertical columnar member and wherein the vertical movement of said car is controlled by a cable and powered winch.

6. The scaffold system claimed in claim 5 further including a cable winch coupled to said vertical columnar member and a cooperating cable hoist at the top end of said columnar member for transporting tools and materials to and from said worker car.

7. The scaffold system claimed in claim 5 wherein said system includes two vertical columnar members each individually movable along said upper and lower rail members, each of said vertical columnar members carrying at least one vertically movable worker car and one of said cable winches and cable hoists.

8. A movable staging scaffold system for positioning workers adjacent the face of a structure, said system comprising:

a frame assembly having at least one substantially horizontal rail connected thereto;

at least one vertical columnar member;

means for moving said columnar member horizontally on said substantially horizontal rail;

a worker car vertically movable on said columnar member; and support means attached to said frame assembly for pivotally attaching said frame assembly to the boom head of a crane, said support means including powered horizontal and vertical axes controls for respectively adjusting the tilt and angular attitude of said frame assembly against a face of said structure.

* * * * *